US006540159B1

(12) United States Patent
Wang

(10) Patent No.: US 6,540,159 B1
(45) Date of Patent: Apr. 1, 2003

(54) PISTOL-TYPE NOZZLE HAVING A SPRAY NOZZLE HEAD ADJUSTABLE IN SPRAY ANGLE

(76) Inventor: Hsin-Fa Wang, No. 68, Mou Tan Lane, Shao An Li, Lu Kang Town, Chang Hua Hsien (TW)

( * ) Notice: Subject to any disclaimer, the term of this patent is extended or adjusted under 35 U.S.C. 154(b) by 0 days.

(21) Appl. No.: 10/237,210

(22) Filed: Sep. 9, 2002

(51) Int. Cl.[7] ..... B05B 7/02
(52) U.S. Cl. ..... 239/525; 239/526
(58) Field of Search ..... 239/525, 526, 239/390, 394, 393, 391, 436, 443

(56) References Cited

U.S. PATENT DOCUMENTS 5,630,548 A * 5/1997 Chih ..... 239/394
5,873,531 A * 2/1999 Wang ..... 239/394
5,967,421 A * 10/1999 Wang ..... 239/526

* cited by examiner

*Primary Examiner*—Lisa A. Douglas
(74) *Attorney, Agent, or Firm*—Harrison & Egbert

(57) ABSTRACT

A pistol-type nozzle includes a handle and a spray nozzle head fastened adjustably to a top end of the handle. The top end of the hand is provided with a first fastening seat, whereas the spray nozzle head is provided at an inner end with a second fastening seat. The first fastening seat is provided with a tubular projection and a locating pin. The second fastening seat is provided with a fastening hole and a plurality of locating slots corresponding in location to the locating pin. The first fastening seat is rotatably fastened to the second fastening seat such that the tubular projection of the first fastening seat is rotatably retained in the fastening hole of the second fastening seat, and that the locating pin of the first fastening seat is removably retained in one of the locating slots of the second fastening seat.

1 Claim, 6 Drawing Sheets

PISTOL-TYPE NOZZLE HAVING A SPRAY NOZZLE HEAD ADJUSTABLE IN SPRAY ANGLE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a pistol-type nozzle, and more particularly to an angularly adjustable spray nozzle of the pistol-type nozzle.

BACKGROUND OF THE INVENTION

The conventional pistol-type nozzle comprises a handle, a control lever, and a spray nozzle which is fixedly fastened with the top end of the handle such that the spray nozzle can not be adjusted in spray angle. Such a fixed spray nozzle causes a great deal of inconvenience in the use of the pistol-type nozzle. As a result, the conventional pistol-type nozzle has a very limited market potential.

BRIEF SUMMARY OF THE INVENTION

The primary objective of the present invention is to provide a pistol-type nozzle which is free of the operational deficiency of the conventional pistol-type nozzle described above.

In keeping with the principle of the present invention, the foregoing objective of the present invention is attained by the pistol-type nozzle comprising a handle, a control lever, and a spray nozzle head adjustable in spray angle. The handle is provided at the top end with a first fastening seat, while the spray nozzle head is provided at the bottom end with a second fastening seat. The first fastening seat is provided with a fastening tubular projection and a retaining slot in which a locating pin is retained in conjunction with a spring. The second fastening seat is provided in the interior with a fastening hole, and in the outer wall with a plurality of locating slots which are arranged at an interval. The first fastening seat is rotatably fastened with the second fastening seat such that the tubular projection of the first fastening seat is rotatably engaged with the fastening hole of the second fastening seat, and that the locating pin of the first fastening seat is retained in one of the locating slots of the outer wall of the second fastening seat. In another words, the spray nozzle head can be angularly adjusted in a step-by-step manner, thanks to the locating pin and the locating slots.

The features, functions, and advantages of the present invention will be more readily understood upon a thoughtful deliberation of the following detailed description of a preferred embodiment of the present invention with reference to the accompanying drawings.

DETAILED DESCRIPTION OF THE INVENTION

As shown in FIGS. 1–4, a pistol-type nozzle embodied in the present invention comprises a handle 10, a control lever 12, and a spray nozzle head 40.

Figure 4:
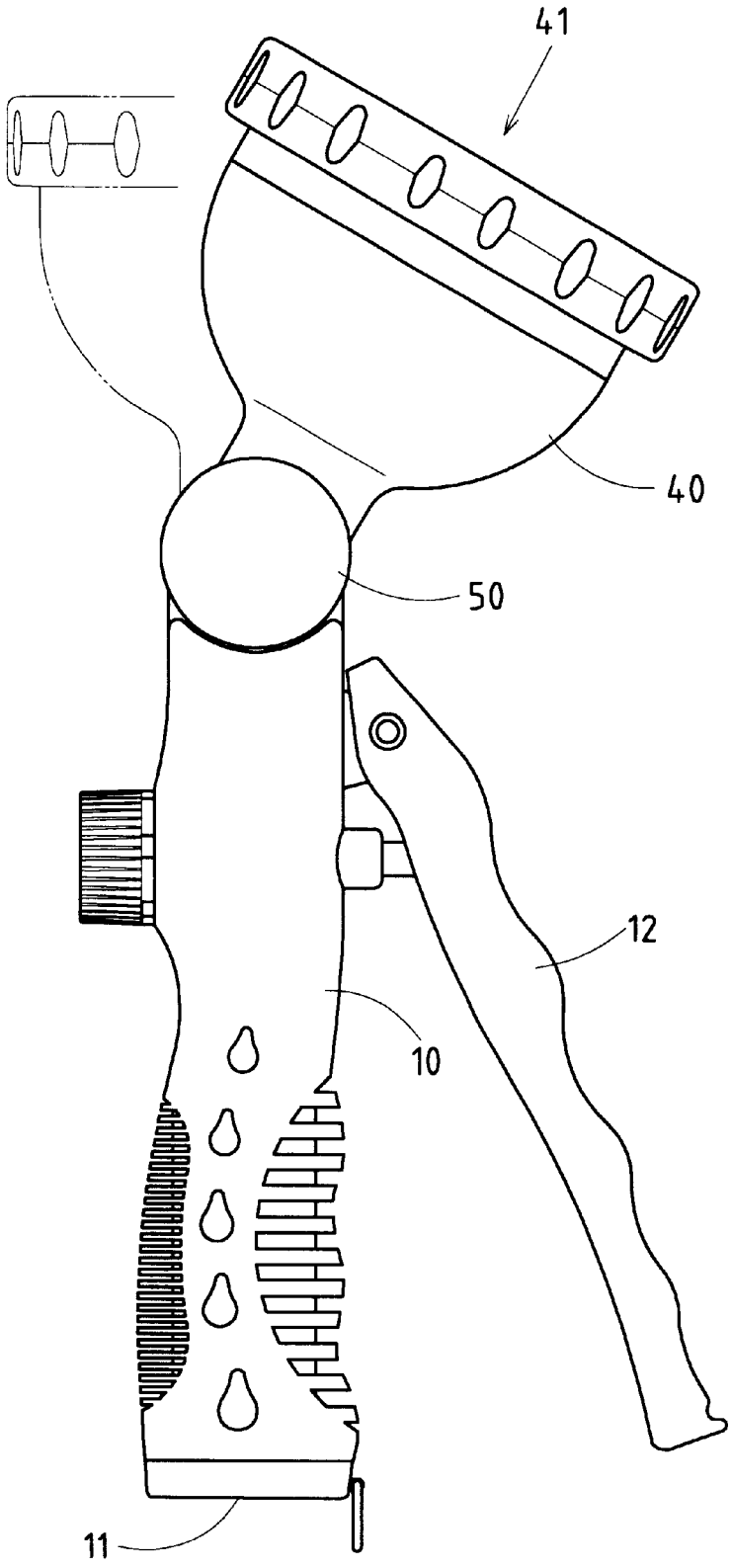
FIG. 4 shows a side schematic view of the preferred embodiment of the present invention.

The handle 10 is provided at the bottom end with a hose connector 11, as shown in FIG. 4. The handle 10 is provided in the interior with a duct 13, which is closed or opened by the control lever 12. The duct 13 is in communication with the hose connector 11. The handle 10 is provided at the top end with a first fastening seat 20 having a first platform 21. The first platform 21 is provided with a tubular projection 22 having a center hole 23 in communication with the duct 13 of the interior of the handle 10. The first platform 21 is provided with an arcuate wall 27 which is provided with a retaining slot 25 of a predetermined depth and extending in the longitudinal direction of the handle 10. Located in the retaining slot 25 is a spring 30 and a locating pin 31 which is urged by the spring 30 such that an outer end of the locating pin 31 is jutted out of the retaining slot 25.

Figure 5:
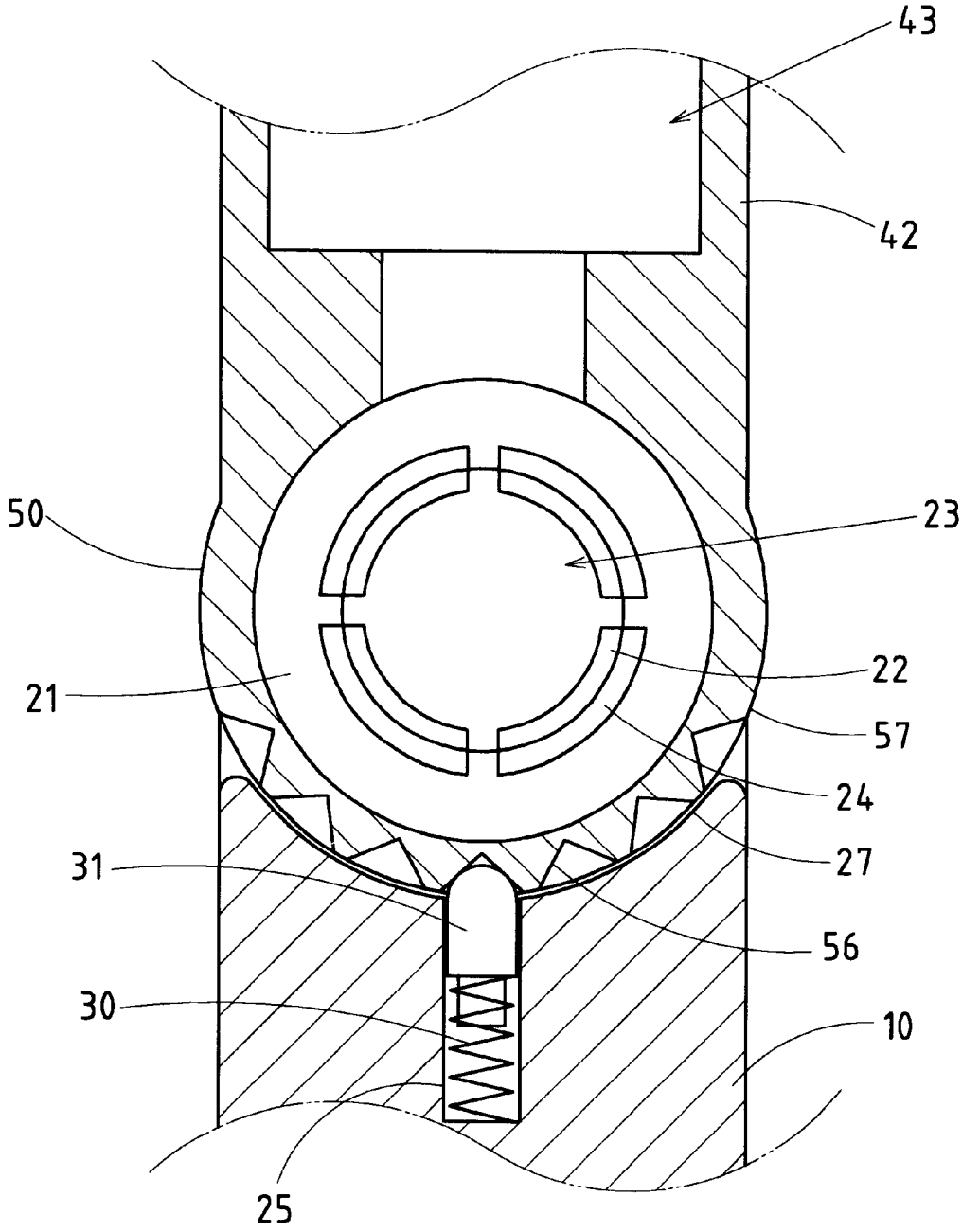
FIG. 5 shows a sectional schematic view of the preferred embodiment of the present invention at work.
Figure 6:
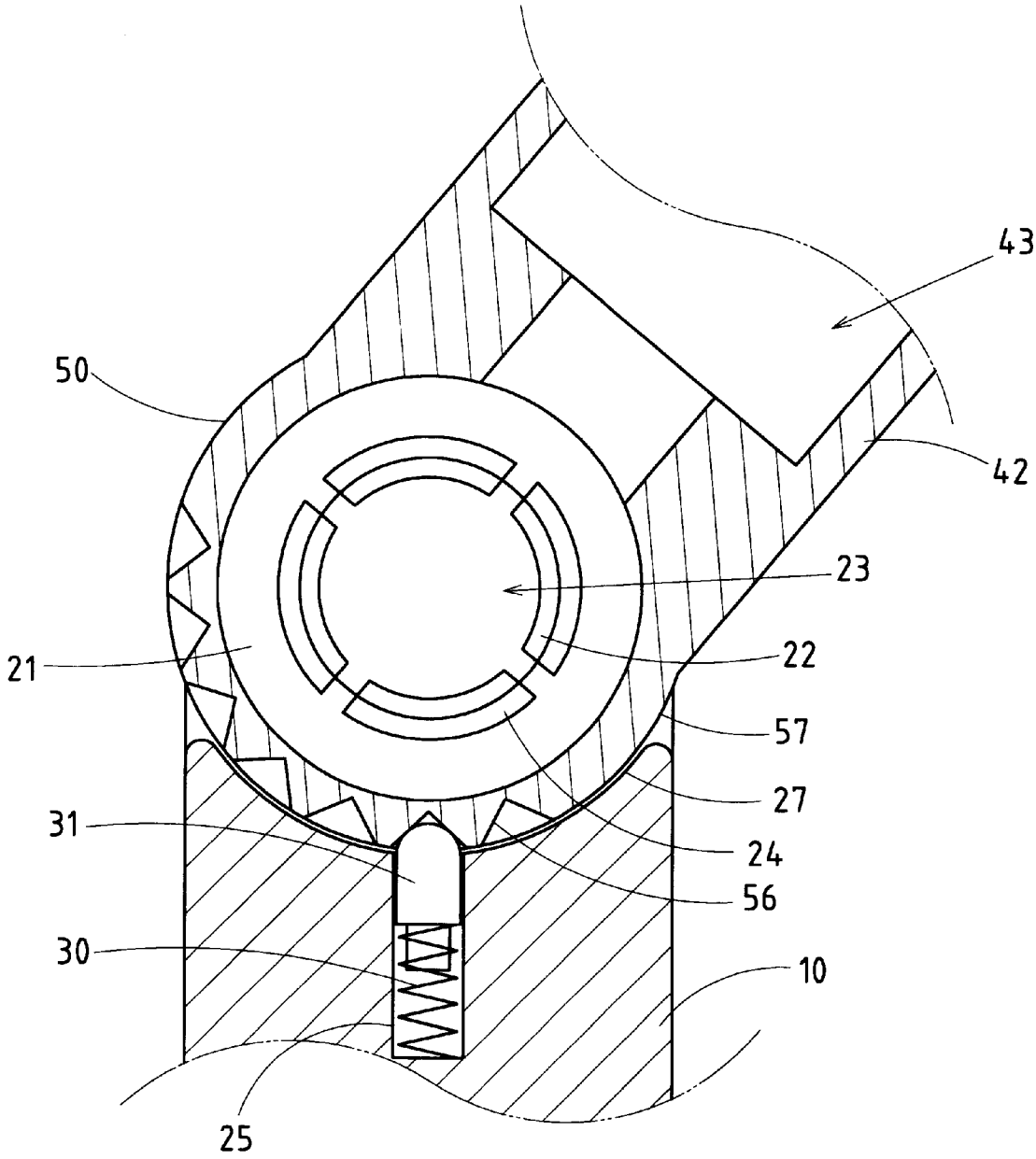
FIG. 6 shows another sectional schematic view of the preferred embodiment of the present invention at work.

The spray nozzle head 40 is provided at the outer end with a plurality of jet nozzles 41, and at the inner end 42 with a second fastening seat 50 which is in turn provided with a channel 51 in communication with a canal 43 of the interior of the spray nozzle head 40. The second fastening seat 50 is provided in the underside with a second platform 52 which is in turn provided in the center with a fastening hole 53. The fastening hole 53 is provided in the inner wall with a circular groove 54 in which a washer 55 is disposed. The second fastening seat 50 is provided in an arcuate outer wall 57 with a plurality of locating slots 56, which are arranged at an interval. The spray nozzle head 40 is joined at the inner end 42 with the top end of the handle 10 such that the second platform 52 of the second fastening seat 50 is rested on the first platform 21 of the first fastening seat 20, and that the tubular projection 22 of the first fastening seat 20 is rotatably retained in the fastening hole 53 of the second fastening seat 50, and further that the outer end of the locating pin 31 of the first fastening seat 20 is removably retained in one of the locating slots 56 of the second fastening seat 50. In addition, an annular protrusion 24 of the outer wall of the tubular projection 22 is rotatably retained in the circular groove 54 of the fastening hole 53 of the second fastening seat 50 in conjunction with the washer 55. As the spray nozzle head 40 is turned in relation to the top end of the handle 10, the locating pin 31 is moved out of one of the locating slots 56, so as to move into other one of the locating slots 56. In light of the locating slots 56 being arranged at an interval, the spray nozzle head 40 can be angularly adjusted in a step-by-step manner, as illustrated in FIGS. 5 and 6.

Figure 1:
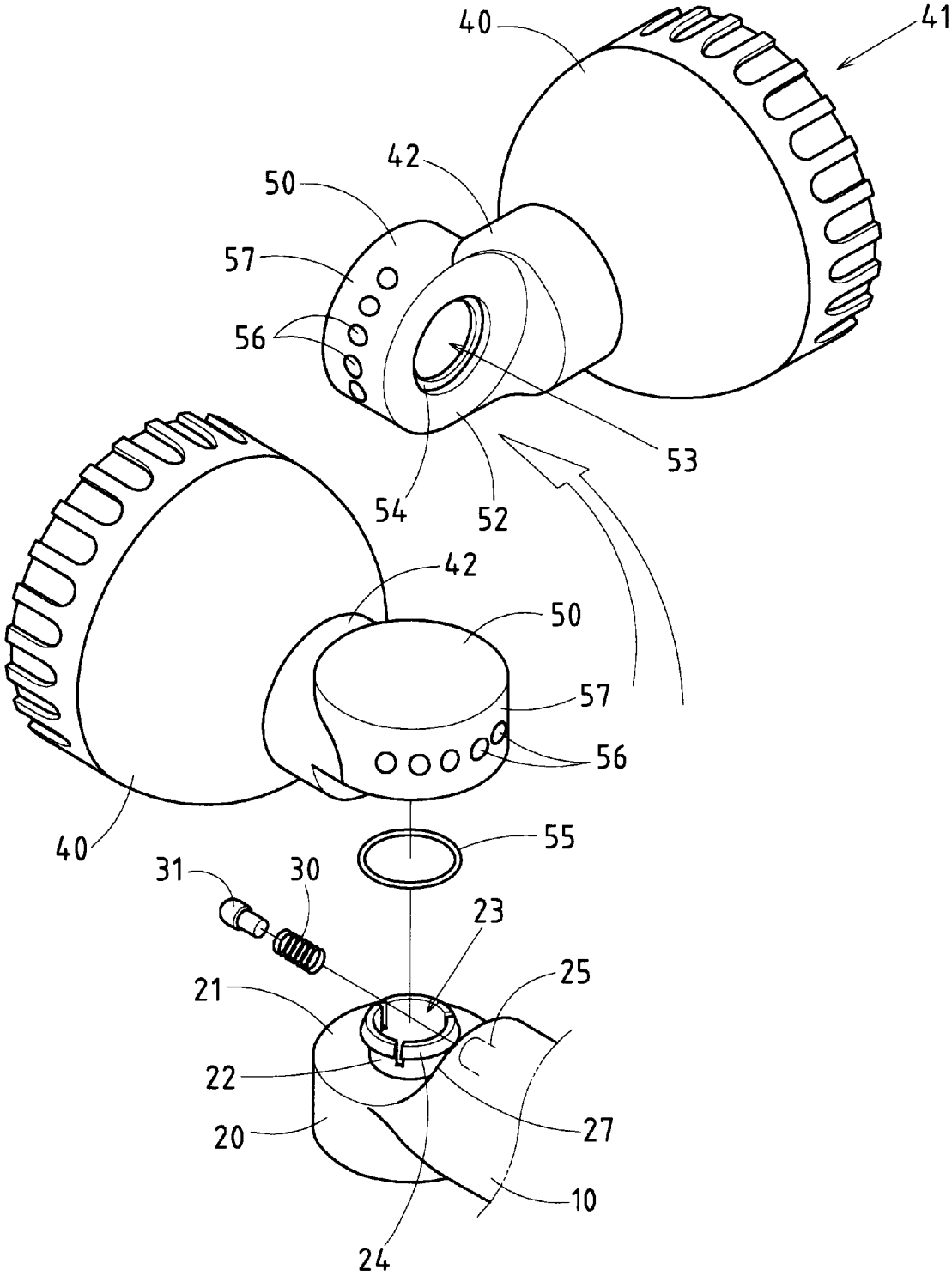
FIG. 1 shows an exploded view of the preferred embodiment of the present invention.
Figure 2:
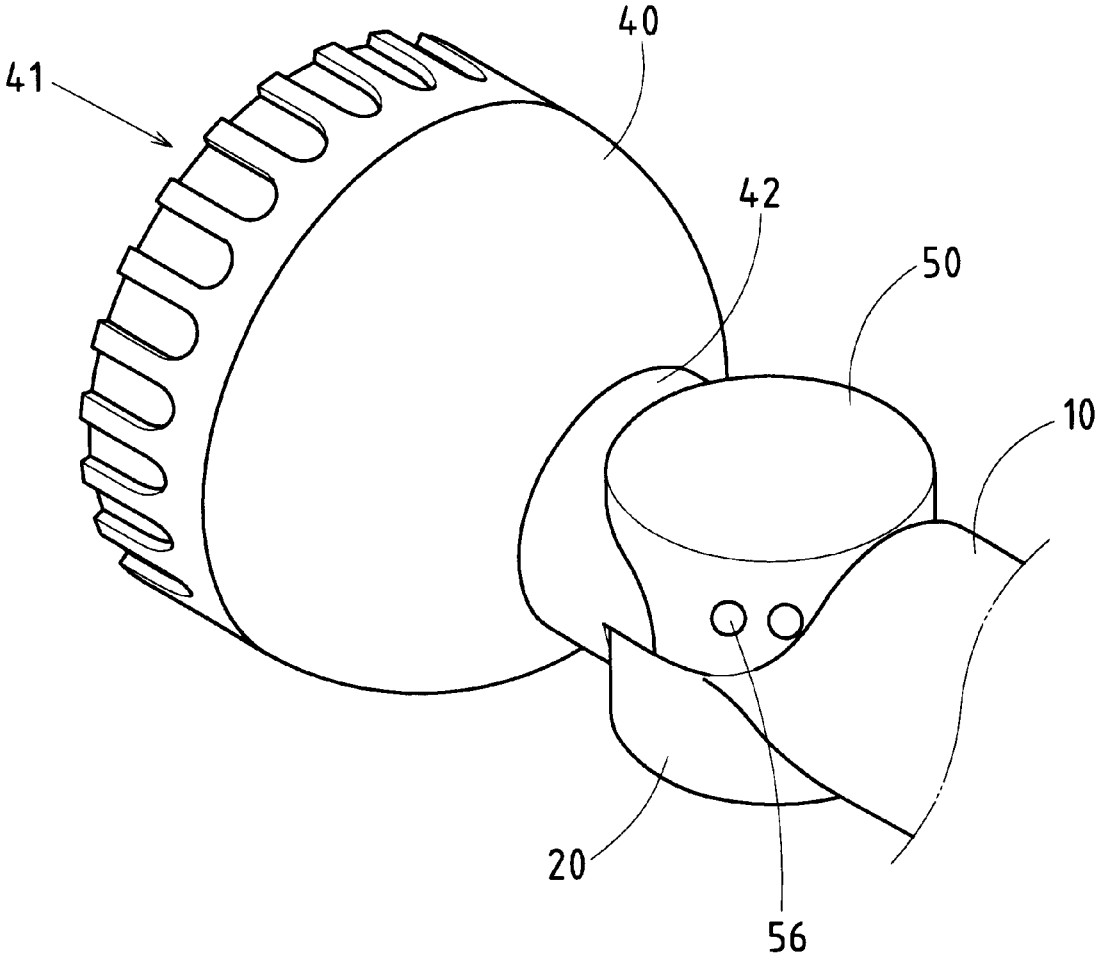
FIG. 2 shows a perspective view of the preferred embodiment of the present invention in combination.
Figure 3:
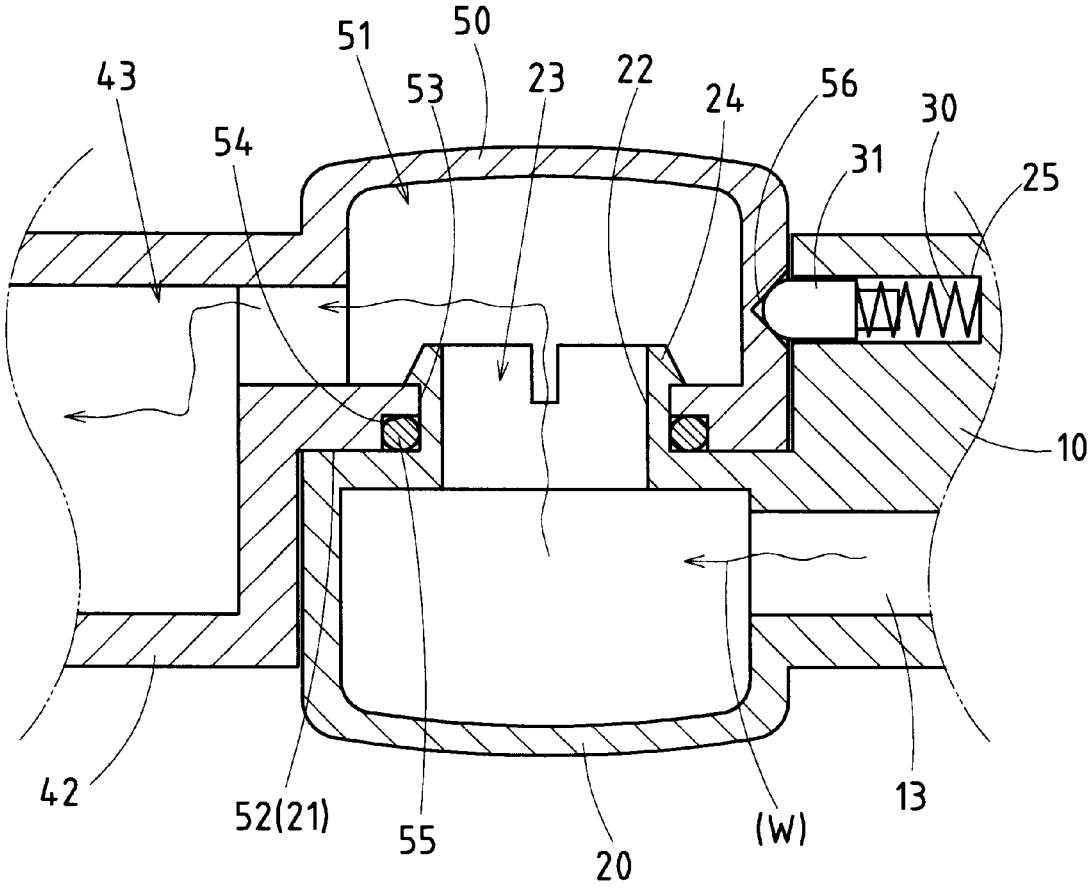
FIG. 3 shows a longitudinal sectional view of the preferred embodiment of the present invention.

As shown in FIG. 3, water "W" is emitted by the jet nozzles 41 of the spray nozzle head 40 via the canal 43 of the interior of the spray nozzle head 40, the channel 51 of the second fastening seat 50, the center hole 23 of the first fastening seat 20, and the duct 13 of the handle 10.

The embodiment of the present invention described above is to be regarded in all respects as being illustrative and nonrestrictive. Accordingly, the present invention may be embodied in other specific forms without deviating from the spirit thereof. The present invention is therefore to be limited only by the scope of the following appended claim.

I claim:

1. A pistol-type nozzle comprising:

a handle provided in an interior with a duct, in a bottom end with a hose connector in communication with the duct, and in a top end with a first fastening seat having a center hole in communication with the duct;

a control lever fastened to the handle for regulating the closing and the opening of the duct of the handle; and a spray nozzle head provided in an interior with a canal, in an outer end with a plurality of jet nozzles in communication with the canal, and in an inner end with a second fastening seat provided with a channel in communication with the canal, said spray nozzle head being rotatably fastened to the top end of said handle such that said second fastening seat of said spray nozzle head is rotatably fastened to said first fastening seat of the top end of said handle;

wherein said first fastening seat of the handle is comprised of a first platform, and an arcuate wall contiguous to said first platform and comprising a retaining slot of a depth, said retaining slot comprised of a spring disposed therein and a locating pin disposed therein such that said locating pin is urged by said spring, said first platform comprised of a tubular projection having a center hole in communication with the duct of the interior of the handle, said tubular projection further having in an outer wall thereof an annular protrusion;

wherein said second fastening seat is provided with a second platform which is in turn provided in a center thereof with a fastening hole, said fastening hole being provided in an inner wall with a circular groove, said second fastening seat having an arcuate outer wall which is comprised of a plurality of locating slots corresponding in location to said locating pin of said first fastening seat whereby said second fastening seat is rotatably fastened to said first fastening seat such that said second platform of said second fastening seat is rested on said first platform of said first fastening seat, and that said tubular projection of said first fastening seat is rotatably retained in said fastening hole of said second fastening seat, and that said annular protrusion of said tubular projection of said first fastening seat is rotatably retained in said circular groove of said fastening hole of said second fastening seat in conjunction with a washer, and further that said locating pin of said first fastening seat is removably retained in one of said locating slots of said second fastening seat.

* * * * *